United States Patent [19]

Brethauer

[11] 4,042,108

[45] Aug. 16, 1977

[54] STACKABLE YARN SUPPORT

[75] Inventor: Dale M. Brethauer, Newark, Del.

[73] Assignee: E. I. Du Pont de Nemours and Company, Wilmington, Del.

[21] Appl. No.: 730,024

[22] Filed: Oct. 6, 1976

[51] Int. Cl.[2] ..... B65D 85/67

[52] U.S. Cl. ..... 206/392; 206/493; 206/509; 217/26.5

[58] Field of Search ..... 206/391–392, 206/394, 408, 415, 480, 493, 509, 526, 558, 565, 596, 598, 821; 217/26.5

[56] References Cited

U.S. PATENT DOCUMENTS

| | | | |
|---|---|---|---|
| 2,378,627 | 6/1945 | Grant | 217/26.5 |
| 3,009,579 | 11/1961 | Ettinger, Jr. | 206/509 X |
| 3,250,564 | 5/1966 | Stern et al. | 206/509 X |
| 3,335,858 | 8/1967 | Sibille | 206/392 |
| 3,375,919 | 4/1968 | Schlager et al. | 206/392 |
| 3,451,577 | 6/1969 | Nurick | 217/26.5 |
| 3,896,929 | 7/1975 | Mills | 206/408 X |

*Primary Examiner*—Steven E. Lipman

[57] ABSTRACT

A device for supporting yarn bobbins during shipment and storage comprises molded plastic pallets and a plurality of spaced, segmented, bullet-shaped protuberances thereon which fit in ends of bobbin tubes for keeping the bobbins immobilized and separated from each other. The protuberances provide for nesting of loaded pallets and stacking of empty pallets without regard for which faces of the pallets are adjacent to each other. The pallets are particularly adapted for loading and stacking by automatic means.

4 Claims, 6 Drawing Figures

STACKABLE YARN SUPPORT

BACKGROUND OF THE INVENTION

This invention relates to pallets for transporting and storing yarn bobbins wound on cylindrical tubes, and is more particularly concerned with a lightweight plastic pallet which can be molded as one integral unit and is suitable for reuse.

In transporting yarn bobbins, the bobbins must be kept immobilized and separated from each other in order to prevent impact or rubbing contact which would damage the yarn or cause it to slip off of the carrier. Any distortion of the winding pattern or snarling of the yarn may be considered to be unacceptable by a customer.

Numerous pallets have been devised to provide a spaced and immobile arrangement of tiers of tubular or cone-shaped yarn bobbins. Pallets constructed of many kinds of materials with various types of holding or centering members have been proposed. Such prior art solutions included dividers fabricated from cardboard, papier-mache or paper pulp. Although pallets of such materials are economical, they do not readily lend themselves to reuse. Pallets composed of steel rods and stamped sheet metal holding members proved reusable but highly expensive to manufacture. Neubert U.S. Pat. No. 3,730,340 dated May 1, 1973, proposes the improvement of molding plastic holding members in two parts which snap together about the intersections of rods. This construction is somewhat more economical but is still expensive in comparison to a pallet molded entirely of plastic in a single operation. Furthermore, although empty pallets can be stacked for reuse by inserting protuberances on one pallet partially into protuberances on another pallet, this can only be done when the proper faces of the pallets are brought together and, even then, the pallets will not be closely stacked.

Pallets of tough molded plastic which are lightweight, inexpensive to manufacture, and can be reused many times have been disclosed in Sibille U.S. Pat. No. 3,335,858 dated Aug. 15, 1967, and Schlager et al. U.S. Pat. No. 3,375,919 dated Apr. 2, 1968. However, a notable deficiency of such prior molded plastic pallets is that the pallets are constructed to nest only when loaded with bobbin tubes. The customer is unable to assemble empty pallets in a neat stack for return to the supplier.

SUMMARY OF THE INVENTION

The present invention is a device for supporting bobbins of yarn wound on open-ended tubes. The device comprises a one-piece pallet molded of synthetic plastic and a plurality of spaced holding members integrally molded to the pallet which extend from each face of the pallet in the form of bullet-shaped protrusions adapted to fit in the ends of yarn tubes to maintain yarn bobbins in spaced relationship. The portion of each holding member which extends from one face of the pallet is composed of two segments disposed at 180° to each other. The portion of each holding member which extends from the second face of the pallet is composed of two segments disposed at 180° to each other and offset 90° from the segments on the first face. The configuration of the segments on the two faces of the pallet is such that a plurality of empty pallets can be stacked with the holding members interengaged when the pallets are not in use for supporting bobbins.

The pallet preferably has a gridwork structure formed of a plurality of intersecting, generally T-shaped struts, and a plurality of spaced flat-top annular ribs surrounding each holding member. The pallet preferably has two centrally disposed gripping holes for mechanical fingering of the pallet.

Two or more empty pallets of this invention will form a neat stack while awaiting use. The segments of the holding members on one face of a pallet interlock with segments of holding members on an adjacent face of another pallet, regardless of which face of the pallet is adjacent to the other face. The stack is useful for returning pallets for reuse. Automatic means can then be used for loading and stacking the lightweight pallets with yarn bobbins for transport to customers.

DETAILED DESCRIPTION

Figure 1:
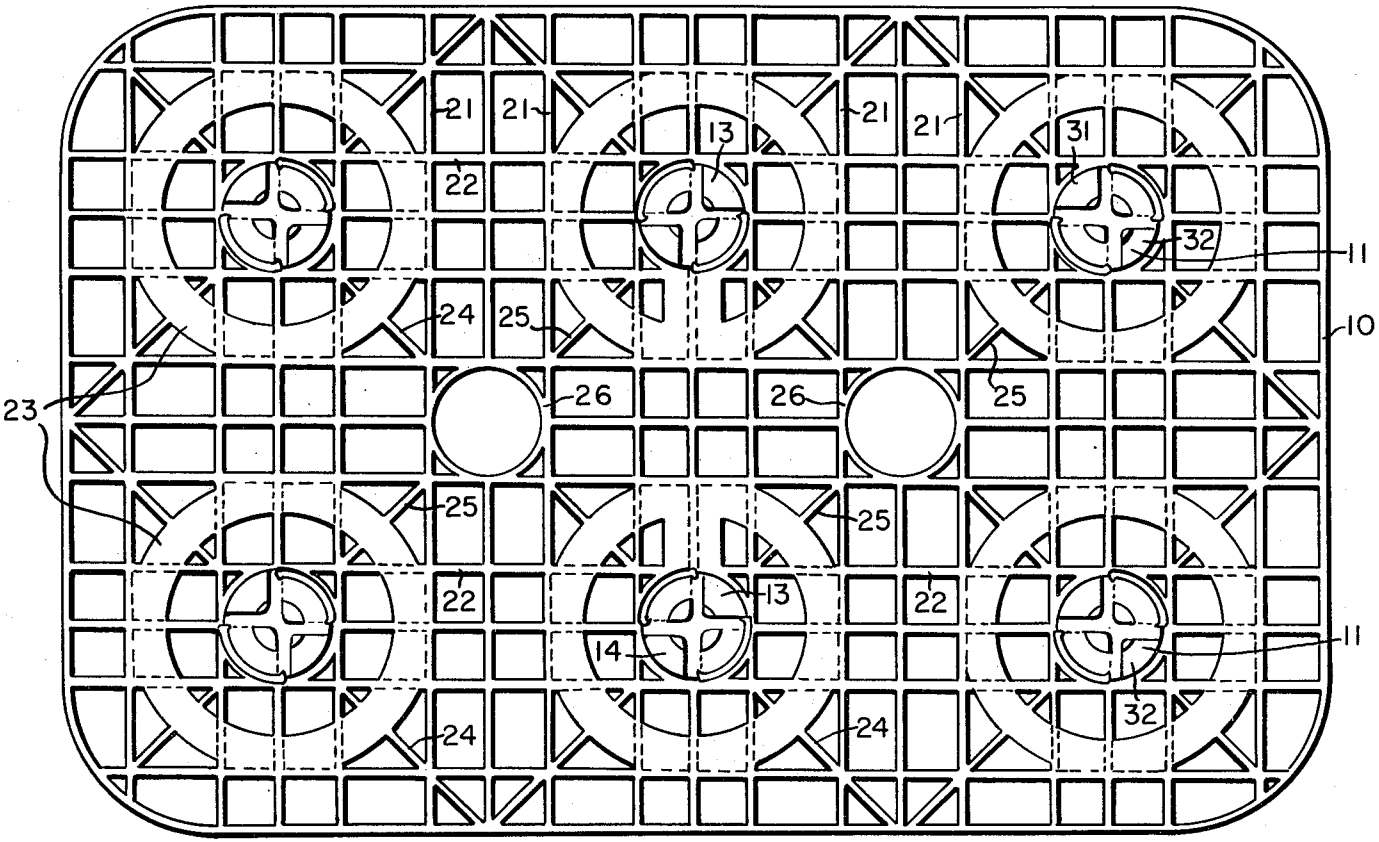
FIG. 1 is a top view of a molded pallet having six holding members for support of yarn bobbins.

In the embodiment of the invention shown in FIG. 1, the pallet is composed of a molded gridwork structure 10 of plastics material. Six holding or centering members 11 are integrally molded to the pallet. Each holding member is adapted to fit into the aperture of a yarn bobbin or tube, and the holding members are spaced apart to maintain bobbins in spaced relationship.

The gridwork structure of the pallet preferably comprises a first plurality of parallel, spaced struts 21, and a second plurality of parallel, spaced struts 22 which intersect struts 21 at substantially 90° angles to form a plurality of rectangular openings. Preferably the struts have a generally T-shaped cross section. The pallet structure also comprises protective flat-top annular ribs 23 surrounding each bobbin holding member to protect the yarn from rubbing contact with the struts. A plurality of struts 24 and 25 are provided with each one extending toward a holding member along diagonals of rectangles formed by struts 21 and 22.

Preferably a pair of apertures 26 are centrally disposed in the gridwork pallet to provide a convenient location for inserting fingers of a mechanically operated device for lifting and transporting the pallet.

The pallet and holding members can be injection molded from high density polyethylene, which is 12 percent filled with glass fibers, to form a strong, lightweight, integral product. A pallet for supporting six yarn bobbins may suitably be 21½ inches by 32½ inches with the holding members separated at center-to-center distances of 10¾ inches.

The invention is in no way limited to this material of construction or these dimensions. The pallet can be designed for any feasible number of holding members, and is not limited to the gridwork structure shown. Any material and structure of sufficient strength can be used.

Figure 2:
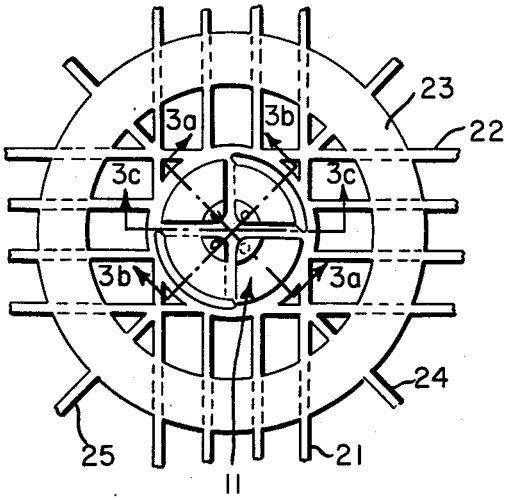
FIG. 2 is a top view of a single segmented holding member.
Figure 3A:
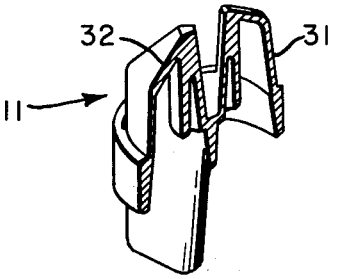
FIG. 3*a* is a sectional view taken on line 3*a*—3*a* of FIG. 2.
Figure 3B:
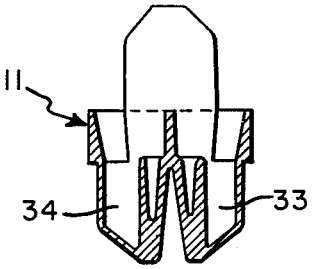
FIG. 3*b* is a sectional view taken on line 3*b*—3*b* of FIG. 2.
Figure 3C:
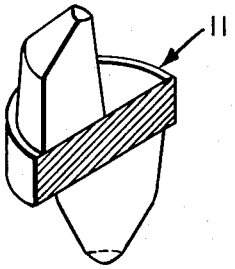
FIG. 3*c* is a sectional view taken on line 3*c*—3*c* of FIG. 2.

Details of a holding member of this invention are shown in FIGS. 2 and 3. FIG. 2 is a top view of a single, segmented holding member 11 which also shows intersecting struts 21, 22, 24 and 25, and annular rib 23. The holding member has four segments which extend alternately above and below the plane of the pallet. As shown in isometric sectional view 3*a*, the two segments 31 and 32 which extend above the face of the pallet are disposed in 180° relationship to each other and are shaped to form a slotted bullet-shaped protrusion for holding a yarn bobbin in position. As shown in sectional view 3*b*, the two segments 33 and 34 which extend below the pallet are disposed in 180° relationship to each other and are offset 90° from segments 31 and 32. All of these segments have similar configurations. Fig. 3*c*, a sectional view from a different direction, shows the configuration of one of the segments when looking at the inside face of the segment.

Figure 4:
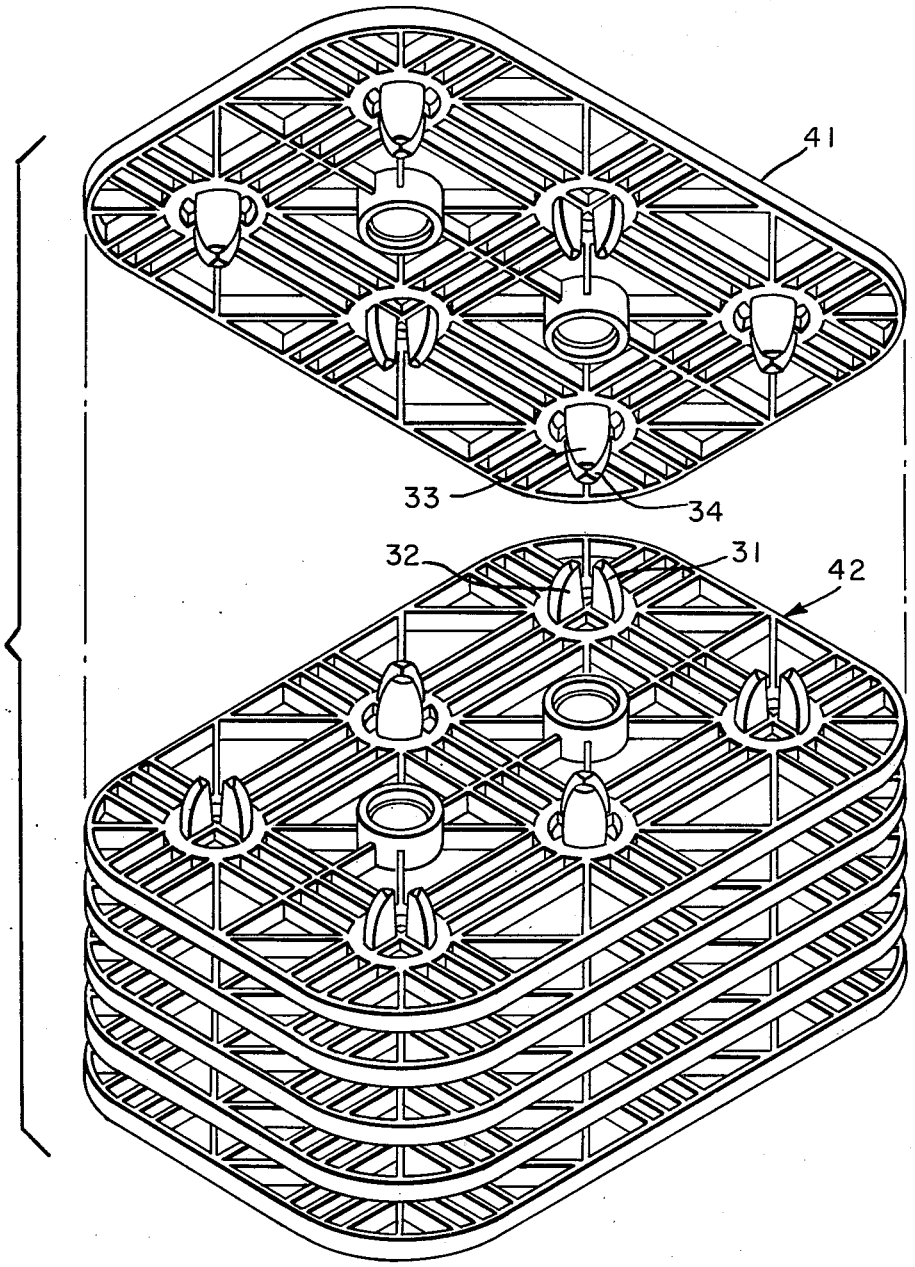
FIG. 4 is a perspective view of a stack of molded pallets having segmented, interlocking holding members.

The pallet described will support bobbin tubes in a separate and immobile condition on holding members extending above and below the planes of pallets when the pallets are arranged in a stack. In addition, as shown in FIG. 4, the empty pallets of this invention will form a neat stack. Since segments 33 and 34 are 90° offset from segments 31 and 32 on an adjacent pallet, segments 33 and 34 fittingly engage or interlock with segments 31 and 32 to form a stack. Furthermore, the pallets will interlock in this manner regardless of any 180° change in orientation and regardless of which face of a pallet is down. Thus the pallet 41 of FIG. 4 can be turned upside down or rotated 180° and it will still interlock with pallet 42 to form a stack.

Preferably, in a stack of pallets, whether loaded or empty, the top and bottom pallets of the stack have holding members which extend from only one face of the pallet, i.e., the outer faces of the stack are free from projecting segments.

The segments of a holding member project alternately from opposite faces of a pallet as described. However, the orientation in some the holding members may differ by 90° from other holding members on the same pallet. In FIG. 1, the segments 13 and 14 of central holding members are offset 90° from segments 31 and 32 of the end holding members. This arrangement may be preferred to lend stability to a stack of like pallets by providing increased resistance to an external force applied against one side of the stack.

I claim:

1. A device for supporting bobbins of yarn wound on open-ended tubes, comprising a one-piece pallet molded of synthetic plastic and a plurality of spaced holding members integrally molded to the pallet which extend from each face of the pallet in the form of bullet-shaped protrusions adapted to fit in the ends of yarn tubes to maintain yarn bobbins in spaced relationship; the portion of each holding member which extends from one face of the pallet being composed of two segments disposed at 180° to each other, the portion of each holding member which extends from the second face of the pallet being composed of two segments disposed at 180° to each other and offset 90° from the segments on the first face, and the configuration of the segments being such that a plurality of empty pallets can be stacked with the holding members interengaged until used for supporting bobbins.

2. A device for supporting yarn bobbins as defined in claim 1 wherein the pallet comprises a gridwork structure formed of a plurality of intersecting, generally T-shaped struts, and a plurality of spaced, flat-top annular ribs surrounding each of the holding members.

3. A device for supporting yarn bobbins as defined in claim 1 wherein the pallet has two centrally disposed gripping holes for mechanical fingering of the pallet.

4. A stack of pallets including at least two pallets each of which comprises a one-piece pallet molded of synthetic plastic having a plurality of spaced holding members integrally molded to the pallet and extending from each face of the pallet in the form of bullet-shaped protrusions adapted to fit in the ends of yarn tubes to maintain yarn bobbins in spaced relationship, the portion of each holding member extending from one face of the pallet being composed of two segments disposed at 180° to each other, the portion of each holding member extending from the second face of the pallet being composed of two segments disposed at 180° to each other that are offset 90° from segments on the first face and interlock with segments of a holding member extending from an adjacent face of the other pallet.

* * * * *